US009474357B2

(12) United States Patent
Vohs

(10) Patent No.: US 9,474,357 B2
(45) Date of Patent: Oct. 25, 2016

(54) MEANS TO ASSOCIATE A FIRST OBJECT AND A SECOND OBJECT

(71) Applicant: Amy Vohs, Polk City, IA (US)

(72) Inventor: Amy Vohs, Polk City, IA (US)

(73) Assignee: Lil' Sidekick, Inc., Polk City, IA (US)

( * ) Notice: Subject to any disclaimer, the term of this patent is extended or adjusted under 35 U.S.C. 154(b) by 114 days.

(21) Appl. No.: 13/970,161

(22) Filed: Aug. 19, 2013

(65) Prior Publication Data

US 2015/0047172 A1 Feb. 19, 2015

(51) Int. Cl.

| | |
|---|---|
| ***A45F 5/00*** | (2006.01) |
| ***F16M 13/04*** | (2006.01) |
| *A45F 5/10* | (2006.01) |
| *A45F 3/14* | (2006.01) |

(52) U.S. Cl.

CPC .. *A45F 5/00* (2013.01); *A45F 3/14* (2013.01); *A45F 2005/002* (2013.01); *A45F 2005/1013* (2013.01); *Y10T 24/316* (2015.01); *Y10T 29/4987* (2015.01); *Y10T 29/49826* (2015.01); *Y10T 29/49844* (2015.01); *Y10T 29/49849* (2015.01); *Y10T 29/49853* (2015.01); *Y10T 29/49947* (2015.01)

(58) Field of Classification Search

CPC ..... A45F 5/00; A45F 2005/002; A45F 2005/1013; A45F 3/14; F16M 13/04; A45C 123/20; B65D 63/1027; Y10T 29/49844; Y10T 29/49849; Y10T 29/49826; Y10T 29/49853; Y10T 29/4987; Y10T 29/49876; Y10T 29/49947

See application file for complete search history.

(56) References Cited

U.S. PATENT DOCUMENTS

| | | | | |
|---|---|---|---|---|
| 3,187,342 | A * | 6/1965 | Aileo | 2/421 |
| 3,626,955 | A * | 12/1971 | Greenwood | 132/273 |
| 6,708,941 | B1 * | 3/2004 | Bowen et al. | 248/345.1 |
| 6,807,715 | B1 * | 10/2004 | Blair | 24/16 PB |
| 2009/0100866 | A1 * | 4/2009 | Creel | 63/1.11 |
| 2010/0221974 | A1 * | 9/2010 | Monaghan | A47D 11/00 446/75 |
| 2011/0103558 | A1 * | 5/2011 | Hooten | A62B 35/04 379/37 |

* cited by examiner

*Primary Examiner* — John C Hong

(74) *Attorney, Agent, or Firm* — Camille L. Urban; David M. Breiner

(57) ABSTRACT

The invention uses a strap to provide a way to associate a first item with a second item. The first item may be, for example, a high chair and the second a toy. The strap is provided with two sets of openings one near each end of the strap, and a tab, post, "T" or other shape near each end of the strap. The shape is inserted through one of the openings and is secured there by its shape, the shape of the opening, and the material with which that portion of the strap is made. The strap is made of nontoxic material and at least in part of material that is flexible and resilient, having a durometer reading of between about 40 and 60 Shore A. The strap may be equipped with at least one breakaway point, usually set for a breakaway pressure between about 3 and 7 pounds.

10 Claims, 3 Drawing Sheets

MEANS TO ASSOCIATE A FIRST OBJECT AND A SECOND OBJECT

FIELD OF INVENTION

The present invention comprises means to associate a first object with a second object where the first object is secured and the second object is detachably attached.

BACKGROUND

With the advent of plastic and the advances made in technology over the past several decades, the number of toys and tools available for use with feeding and entertaining small children has exploded. With that explosion has evolved a need for ways to keep toys, eating and drinking utensils, and educational playthings from being thrown or falling to the floor where a child in a car seat or high chair is unable to reach them. Several possibilities have been developed: an activity toy consisting of a metal wire frame about 7 inches high and 10.5 inches wide attaches to a high chair tray by two large red suction cups. Several brightly colored plastic toys hang from the wire frame for the child to play with. This toy is not convertible or able to be used with other toys, requires a flat surface to which the suction cups can adhere, and sits directly in front of the child which means it will need to be moved when the child tires of playing with it. Certain other toys come with a strap which is intrinsic to the toy. The single end of the strap may include a clipping mechanism which is intended to be associated with the car seat or high chair or crib, or even with the child's clothing. Pacifiers and teething rings include these types of attachments. However, most include a strap having one end equipped to attach to the child's clothing via a clip, and the other may include a fabric loop secured by Velcro, which may be threaded through the ring typically present on the pacifier. Many of these tools do not include a breakaway point to avoid strangulation, many include choking hazards, some include materials that absorb biofluids and are difficult to adequately clean.

Straps are available for securing toys to another object; one such strap brand name NiNi Toy Bungee includes two separate pieces, the first of which is an anchor portion having an eye through which the end may be threaded to form a slip-loop and a snap or clipping mechanism for a purpose to be described, the second piece comprising a strap portion having openings and buttons spaced apart near a first end, and a snap or clipping mechanism on the other the end to mate with and be secured to the snap or clipping mechanism on the anchor portion. The first end of the strap portion may be arranged to form a loop around a toy, or sippy cup, etc., and secured by inserting one of the buttons into one of the openings. While this strap accomplishes the objective of securing a toy or first item to a second, it is rather complex. Further, the snapping mechanism poses pinch possibilities and buttons appear to create a choking hazard. Finally, this strap does not appear to include any breakaway feature despite the fact that its length may possibly encircle an arm or leg, and, perhaps, a neck.

Another securing device on the market includes an elastic band covered by gathered fabric, each end completed by a snap or clipping device. As the elastic is stretched the fabric's gathers elongate to allow for the increase in length. The fabric covered strap may be a strangulation hazard; the clips can pose a choking hazard. The fabric and elastic are materials that may absorb biological fluids which require washing, yet, it is not certain that these materials will withstand multiple washes, nor whether the associated clips may be washable to the extent required. Importantly, the clips are unlikely to be strong enough to withstand much pressure and they do not provide means to associate hard objects with the straps; if one attempts to loop the strap around an object and associate the clip with the strap thereby securing the object, it is highly likely that when the strap is stretched the clip will disengage.

What was needed was a means to secure a toy or other object in a manner that removes choking and strangulation hazards, is simple to use, and is durable while being constructed of nontoxic materials.

A first objective of the present invention is to provide means to associate a first item and a second item;

A second objective is to provide means that do not include any detachable parts, that is of unitary structure made of nontoxic material;

A third objective of the present invention is to provide a strap device that includes breakaway features to minimize or eliminate strangulation hazards;

A fourth objective of the present invention is to provide a strap device for associating a first object with a second object which is adjustable in accordance with the size of the second object, and is durable both for its intended use and for easy cleaning as often as needed.

BRIEF SUMMARY OF THE INVENTION

The present invention comprises a method and a means to detachably secure a first object to a second object, said means comprising an elongated member having a secured end and an attaching end. The invention is comprised at least partially of material having resiliency but at a low level which allows the securements to capitalize on friction to improve the security, but not so resilient as to pose a strangulation hazard. The first end is designed to attach to a secure object such as high chair or car seat, while the second end is designed to provide adjustability for detachably attaching an object such as a sippy cup or a toy. The invention is preferably of unitary construction of a single material, which material is non-toxic and can withstand the rigors of a dishwasher and typical dish detergent.

DETAILED DESCRIPTION OF THE INVENTION

Figure 1:
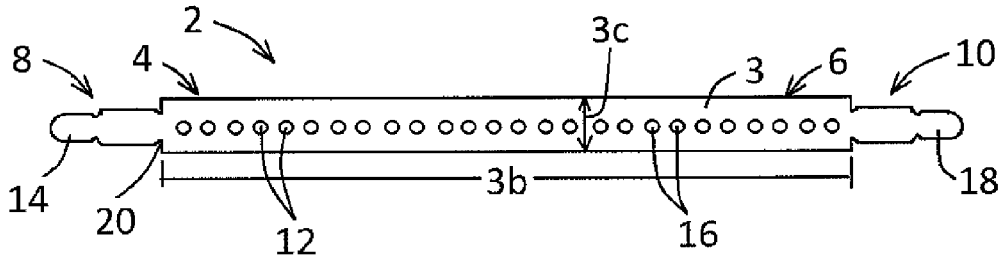
FIG. 1 is a perspective of the present invention.
Figure 2:
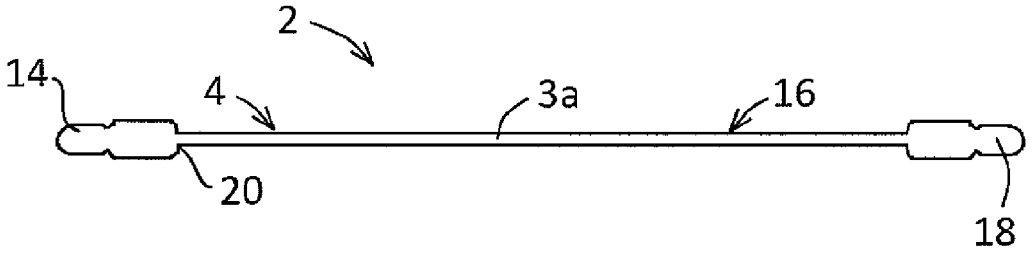
FIG. 2 is a side view of the present invention.
Figure 3:
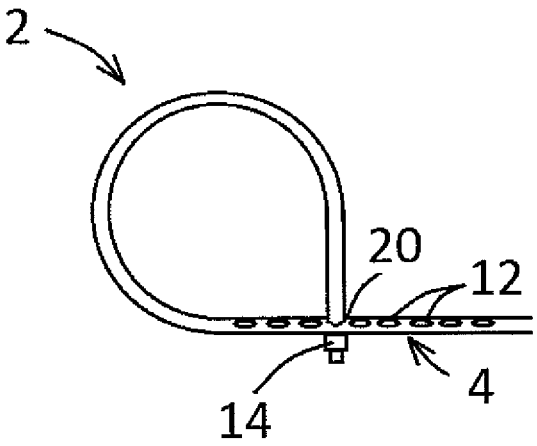
FIG. 3 is a perspective showing the securing means inserted through one of the plurality of openings in the first end of the elongated member.

2 indicates the invention as a whole

3 labels an elongated member having a thickness 3*a* and a length 3*b* and a width 3*c*

4 is a first portion of the elongated member

6 is a second portion of the elongated member

8 indicates a secured end of the first portion

10 labels an attached end of the second portion

12 indicates a plurality of openings in the first portion

14 labels a securing means proximal the end of the first portion

16 indicates a plurality of openings in the second portion

18 labels an attaching means proximal the end of the second portion

The present invention comprises a method and a means 2 to detachably secure a first object to a second object, said means 2 comprising an elongated member 3 having a first portion 4 with an end 8, and a second portion 6 with an end 10, said elongated member 3 comprised at least partially of a low-resiliency material such as Santoprene. Said elongated member 3 having a secured end 8 at the end of the first portion 4 and an attaching end 10 at the end of the second portion 6 of the elongated member 3. The secured end 8 of the first portion comprising means to secure 12 and 14 the secured end to the elongated member at one of several positions; said attaching end of the second portion comprising means to detachably secure 16 and 18 said attaching end to said elongated member at one of several positions.

Said means to secure said secured end comprising one of a plurality of openings 12 in said first portion of said elongated member, and a securing means 14 proximal to an end of the first portion, said securing means 14 sized to be inserted through said opening 12 which is smaller in at least one dimension than said securing means 14 and stretches to receive said securing means and then returns generally to its original size, thereby holding the securing means 14 in place by the elastic action of the low resilience material.

The securing means of one embodiment comprises a ball formed of the low-resiliency material positioned at the end of the first portion of the elongated member; a second embodiment includes a ball formed near the end of the first portion of the elongated member but projecting perpendicular to the plane of the elongated member; a third securing means may be of any shape that may be inserted through one of said openings, but is retained there by the resiliency of the material. A fourth securing means may include a "T" wherein the horizontal bar of the "T" is inserted through one of the openings and may be turned about 90 degrees thereby blocking the exit of the "T" from the opening. Openings that are slightly elongated work well with the "T" arrangement.

Said means to detachably position the attaching end comprises a plurality of openings 16 in the second portion and attaching means 18 proximal to the end of the second portion 6. Said attaching means 18 may include a ball or other shape formed of the low resiliency material positioned near or at the end of the second portion 6 of the elongate member 3. Said plurality of openings 16 are sized slightly smaller in at least one dimension than the attaching means which attaching means 18 may be inserted through one of said plurality of openings 16 in the second portion 6 of the elongated member 3 and retained therein by the resiliency of the material.

The method for securing a first object to a second object comprises looping the first portion 4 of the elongated member 3. around at least a portion of the first object and inserting the securing means 14 through one of said plurality of openings 12 in the first portion 4 of the elongated member 3; looping the second portion 6 of the elongated member 3 around at least a portion of the second object and inserting the attaching means 18 through one of said plurality of openings 16 in the second portion 6 of the elongated member 3.

The present invention is ideal for securing a child's car seat to a child's toy or for securing a child's high chair to a child's spoon or the like. In each situation, the first end is secured to the first object and the second end is secured to the second object. The ease with which the invention may be employed makes it simple to remove the second object and replace it with a different object of a different size. One may elect to have a plurality of the present invention associated by their first ends with different first objects thereby allowing a second object to be easily transferred from one first object to another and detachably attached thereto.

The present invention is preferably of unitary structure, however, that is not necessary to enjoy the benefits of the invention. In an embodiment of the present invention, the invention is of unitary construction and comprises Santoprene which is a nontoxic rubber-containing material. Other materials that may be acceptable include other flexible, non toxic materials of similar hardness and resiliency. The present invention includes at least one portion with a breakaway point 20 having a limitation of no more than 50 lbs; another embodiment comprises a plurality of breakaway sections 20; yet other embodiments comprise at least one portion that consists of material that will break at no more than 50 lbs, or no more than 40 lbs, or no more than 30 lbs or no more than 20 lbs.

The resiliency of the material where the openings are formed is important to the performance of the invention. So, too, is the level of resiliency of the material of which the securing means and the attaching means are made. Too resilient may make the device difficult to use; not enough resilience will result in slippage of the securing means or the attaching means from the openings into which they are inserted. Further, appropriately selected resilient material should also provide for friction hold to assist in resistance of slippage of the attaching means or the securing means from an opening into which one was inserted.

Without wishing to be limited to the following dimensions, an example of the invention may be described as being made wholly of Santoprene which is a flexible thermoplastic vulcanizate of long life and is available in hardness grade from 35 Shore A to 60 Shore D. It has good compression set at room temperature and moderate performance at high temperature up to 135° C. Service temperature is 135° C. (permanent) and 150° C. (temporary). It is recyclable and is used to make wet suits and gaskets. The material in the invention has a durometer reading (indicating flexibility) of 50 which is similar to that of weather stripping used on windows. The breakaway point(s) is between the securing means and the end of the strap, and the attaching means and the end of the strap. The breakaway pressure is about 5 pounds for each breakaway point. This particular embodiment is about 22 inches long, the plurality of openings are spaced anywhere from about 0.15 to about 0.75 inches apart. The depth of the elongated member is about 0.080.

The present invention has been described. Example embodiments of the invention have been described in an illustrative manner. It is to be understood that the terminology that has been used is intended to be in the nature of words of description rather than of limitation. Many modifications and variations of example embodiments are possible in light of the above teachings. Therefore, within the scope of the appended claims, the present invention may be practiced otherwise than as specifically described.

What I claim is:

1. Means to secure a first object to a second object, said means comprising an elongate member of unitary structure and comprising a single material, said member having a first portion having a securing end and a second portion having an attaching end and at least two breakaway points to reduce likelihood of strangulation or constriction, each said break away point located near one of said securing end or said attaching end and weaker than the remaining portions of the elongate member to allow separation of the relevant end from the elongate member upon application of pressure, the first portion comprising more than one opening through which said securing end or said attaching end may be inserted to secure the first object to said elongate, the second portion comprising more than one opening through which said securing end or said attaching end may be inserted to secure the second object to the elongate member.

2. The means of claim 1, the attaching end comprising attaching means consisting of said single material and sized to fit through said at least one opening in one of said first portion or said second portion: said elongate member comprising a first width; said single material being flexible and having adequate resiliency to retain said attaching means positioned through said opening, wherein said breakaway point comprises a second width narrower than the first width.

3. The means of claim 1, said securing end comprising securing means said securing means sized to fit through said at least one opening in said first portion, and said attaching means sized to fit through said at least one opening in said second portion and said elongate member comprises a flexible material having adequate resiliency to retain said securing means positioned through said opening in said first portion and said attaching means positioned through said opening in said second portion.

4. The means of claim 3, wherein fitting securing means through said at least one opening in said first portion creates a loop in said first portion, and fitting attaching means through at least one opening in said second portion creates a loop in said second portion.

5. The means of claim 3, said second breakaway point having a breakaway pressure of between about 3 pounds and about 7 pounds.

6. The means of claim 5, wherein said first break away point comprises a point positioned where said securing means and said first portion of the elongate member meet and said second break away point comprises a point positioned where said attaching means and said second portion of the elongate member meet.

7. The means of claim 6, wherein the breakaway pressure at each of said breakaway point is about five pounds.

8. The means of claim 3, wherein said elongate member comprises a thermoplastic vulcanizate of hardness between about 35 Shore A and 60 Shore A.

9. The means of claim 3, comprised completely of non-toxic material.

10. The means of claim 1, wherein one of said breakaway point separates upon application of tension between the elongate member and the securing end and the other of said breakaway point separates upon application of tension between the elongate member and the attaching end.

* * * * *